US006687964B2

(12) United States Patent
Vanderpool

(10) Patent No.: US 6,687,964 B2
(45) Date of Patent: Feb. 10, 2004

(54) STRAP LOCK

(76) Inventor: Rick Vanderpool, 16231 Annatto Ct., Chino Hills, CA (US) 91709

( * ) Notice: Subject to any disclaimer, the term of this patent is extended or adjusted under 35 U.S.C. 154(b) by 0 days.

(21) Appl. No.: 10/121,948

(22) Filed: Apr. 11, 2002

(65) Prior Publication Data

US 2003/0192153 A1 Oct. 16, 2003

(51) Int. Cl.[7] ..... A44B 11/25
(52) U.S. Cl. ..... 24/614; 24/265 BC
(58) Field of Search ..... 24/704.1, 704.2, 24/614, 615, 625, 662, 265 BC; 70/57.1, 58, 63; 292/91, 117

(56) References Cited

U.S. PATENT DOCUMENTS

| | | | | | |
|---|---|---|---|---|---|
| 3,956,805 | A | | 5/1976 | Stroh | 24/505 |
| 4,261,493 | A | | 4/1981 | Newman | 224/257 |
| 4,809,410 | A | | 3/1989 | Van Riesen | 24/574 |
| 4,953,269 | A | * | 9/1990 | Ragsdale | 24/704.1 |
| 4,958,416 | A | | 9/1990 | Frishling | 24/170 |
| 5,005,269 | A | | 4/1991 | Hirsch | 24/668 |
| 5,067,213 | A | * | 11/1991 | Ragsdale et al. | 24/704.1 |
| 5,097,572 | A | | 3/1992 | Warrick | 24/645 |
| 6,202,262 | B1 | | 3/2001 | Hamburger, III | 24/265 H |
| 6,418,760 | B1 | * | 7/2002 | Fettes | 70/71 |

FOREIGN PATENT DOCUMENTS

| | | | | |
|---|---|---|---|---|
| FR | 2 635 652 | * | 3/1990 | 24/163 R |

OTHER PUBLICATIONS

US patent application publication US 2002/0014096 A1, Kaneko et al., Feb. 2002.*

* cited by examiner

*Primary Examiner*—Robert J. Sandy
*Assistant Examiner*—Ruth C. Rodriguez
(74) *Attorney, Agent, or Firm*—Knobbe, Martens, Olson & Bear LLP

(57) ABSTRACT

A quick-connect strap lock assembly for use with, for example a spa cover and a spa, is provided generally comprising a first male clip portion receivable within a second female lock portion and a key portion receivable in a key hole of the lock portion. The male clip portion generally includes a first end with a pair of legs each leg having a barbed end. The male clip portion also typically includes a second end for receiving a strap. The female lock portion generally includes a first main opening sized to receive the legs of the male portion, and a second opening adapted to receive the key. The female lock portion also typically includes one or more posts in communication with the first main opening. The posts are preferably adapted to engage the barbed ends of the male clip portion in order to secure the male clip portion to the female lock portion. Insertion of the key into the keyhole preferably disengages the male clip portion from the female lock portion, thereby allowing the male clip and female lock portions to be separated.

17 Claims, 3 Drawing Sheets

STRAP LOCK

BACKGROUND

1. Field of the Invention

The invention relates in general to the field of strap locks, and specifically to a quick-connect strap lock.

2. Description of the Related Art

Numerous strap related devices are disclosed the prior art, as will be described further below. For example, U.S. Pat. No. 6,202,262 teaches a quick disconnect coupling for adapting a guitar strap. According to the '262 patent, the strap has a pair of ends with throughbores to a guitar having a pair of strap-attaching pegs that engage the throughbores respectively. The coupling includes a first portion that engages a first guitar strap-attaching peg, and a second portion, which is releasably engaged to the first portion and engages the throughbore in a first end of the pair of ends of the guitar strap. The first and second portions are releasably engaged by a first apparatus, and the second portion is attached to the first end of the guitar strap by a second apparatus.

Another example, U.S. Pat. No. 5,097,572 to Warrick, teaches a parachute canopy strap connecting device. According to the, 572 patent, the device comprises a male strap connector having a locking tang including a locking notch, a female strap connector having a housing including a slot for receiving the tang for insertion to a locking position, and a locking lever having a handle mounted on the housing and including a lock shoulder movable into and out of the slot as the locking lever is moved between extreme lock and unlock positions. A spring is provided to bias the locking lever to lock position, and a cover lever is mounted on the housing for movement between positions covering and uncovering the locking lever handle. A second spring biases the cover lever to covering position, and a blocking pawl is mounted on the housing for movement between a normal biased position, blocking movement of the locking lever from unlock to lock positions, and an unblocking position forced by engagement of a contact surface by the locking tang, upon its insertion to locking position. This enables movement of the locking lever to locking position to move the lock shoulder into the tang slot to lock the male strap connector to the housing.

U.S. Pat. No. 5,005,269 to Hirsch recites a spring clip closure member for resiliently fastening onto a button type projection, of the type typically used in suspenders, jeans, and other garments. The spring clip includes an inverted U-shaped resilient wire loop having a bight portion for suspension from the gannet. A pair of opposing leg portions each terminate in inwardly directed feet with downwardly directed fingers. The fingers are resiliently separable but are normally biased toward each other. An encasement member envelopes the feet portions and includes a closed pocket for receiving and enveloping depending finger portions. The finger portions can laterally move within the closed pocket so as to engage and release the button type projection. Lateral apertures are provided in the encasement member through which the feet portions extend during a closure operation.

Still another example, U.S. Pat. No. 4,958,416 to Frishling, recites a comfort clip that is comprised of a base with two arms integrally formed therewith and a latch movably mounted thereon to clamp the shoulder harness strap or lap belt strap at a selected position thereon. When two of such comfort clips are used, one on the shoulder harness strap and one on the lap belt strap a rod is connected therebetween to pull the shoulder harness strap sufficiently down so that it is comfortable on the shoulder of a diminutive user. The ends of the rod are held in place on the comfort clips by the straps and are locked in place by the latch.

U.S. Pat. No. 4,809,410 to Van Riesen recites end pieces, each having a carrier element for a shoulder strap to be fastened thereto and a crotch strap end piece for attachment to a crotch strap. Each of the end pieces has an attachment element for retention on the lock tongue and the attachment elements have complementary shaped free ends by which the shoulder and crotch strap end pieces can engage and fit together independently of the lock tongue. The lock is assembled by fitting together the attachment elements and then passing the lock tongue through the assembled elements and into the lock case.

Another example, U.S. Pat. No. 4,261,493 to Newman, recites an elongated strap, having metal threads to deter cutting, that includes a non-removable ring at one end and a combination lock secured to the other end, for providing an over the shoulder carrier for skis and poles, and a wrap-around lock for securing skis and poles to an anchor.

U.S. Pat. No. 3,956,805 to Stroh recites a clip which fastens to garments. The function of the clip is to preclude the strap or carrying cord from slipping off the shoulder of the user and to prevent theft. The outermost is surface of the clip can be decoratively finished.

Thus, the majority of the prior art teaches strap locks for attaching a first strap to a second strap. Notwithstanding the above devices, there remains a need for a strap locking device for use in removably locking a flexible strap to a solid surface such as for locking a strap of a spa cover to a spa side wall.

SUMMARY

One aspect of the present invention includes a novel system for removably unlocking a flexible strap from a lock comprising a first clip portion having a first end with a pair of legs, a key portion, and a second lock portion with both a first opening sized to receive the legs of the first portion and a second opening sized to receive the key. The first clip portion is generally configured to engage the second lock portion such that the first and second portions are held substantially securely relative to one another. The key portion is preferably configured to disengage the first clip portion from the second lock portion, thereby facilitating removal of the first portion to be removed from the second portion. One contemplated application of the present invention is securing a spa cover to a spa where, for example, a strap may be affixed to a spa cover such that, when placed on top of a spa, the strap may be secured in an unlockable fashion to the side wall of a spa.

In another embodiment of a strap lock assembly having preferred features and advantages, a housing is provided having a first opening adapted to receive a clip, a second opening adapted to receive a key, and a post located between the first and second openings. The clip preferably has at least one barbed leg adapted to engage the post, thereby securing the clip to the housing. According to this embodiment, insertion of the key into the second opening of the housing disengages the barbed leg from the post, thereby allowing the clip to be removed from the housing.

Another embodiment of a quick-connect strap lock assembly includes a female portion having a main opening, a key slot, and a post located between the key slot and the main opening. The assembly also includes a male portion having a first end insertable into the female portion and including a barbed leg adapted to engage the post to securely connect the male portion to the female portion. As in the previous embodiment, insertion of the key into the key slot allows the male portion to be released from the female portion.

For purposes of summarizing the invention and the advantages achieved over the prior art, certain objects and advantages of the invention have been described herein above, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention, certain preferred embodiments and modifications thereof will become apparent to those skilled in the art from the detailed description herein having reference to the figures that follow, of which.

DETAILED DESCRIPTION OF THE INVENTION

Figure 1:
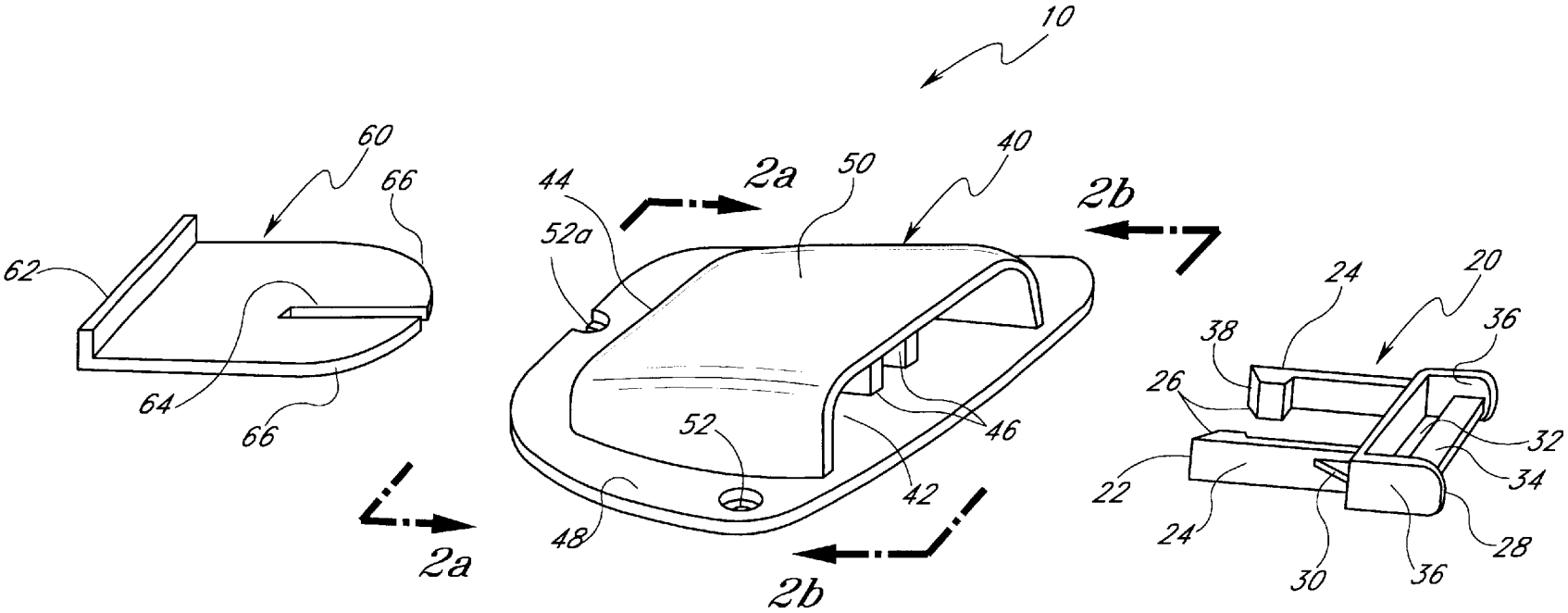
FIG. 1 is a perspective assembly view of a strap lock assembly comprising a key portion, a clip portion, and a lock portion.
Figure 2B:
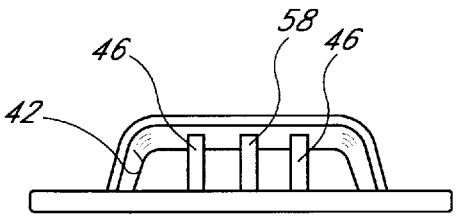
FIG. 2*b* is an opposite view of the lock portion of the assembly of FIG. 1.
Figure 2A:
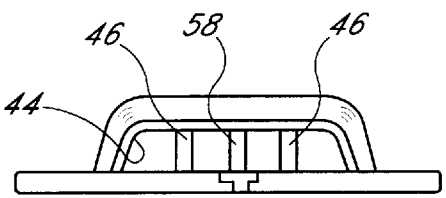
FIG. 2*a* is an end view of the lock portion of the assembly of FIG. 1.

As shown in FIG. 1, the present invention comprises a strap lock assembly 10 comprising generally a first male clip portion 20 receivable within a second female lock portion 40, and a key portion 60. The male clip portion 20 generally comprises a first end 22 with a pair of legs 24 each having a barbed end 26, and a second end 28 for receiving a strap. The female lock portion 40 generally includes a housing 50 having a first main opening 42 sized to receive the legs 24 of the male clip portion 20, and a second keyhole opening 44 (see FIG. 2a) adapted to receive the key portion 60. The female lock portion 40 also preferably includes one or more posts 46 (FIG. 2b) internally positioned within the housing 50. The posts 46 are preferably adapted to engage the barbed ends 26 of the legs 24 of male clip portion 20 in order to secure the male clip portion 20 to the posts 46 of the female lock portion 40.

Figure 3:
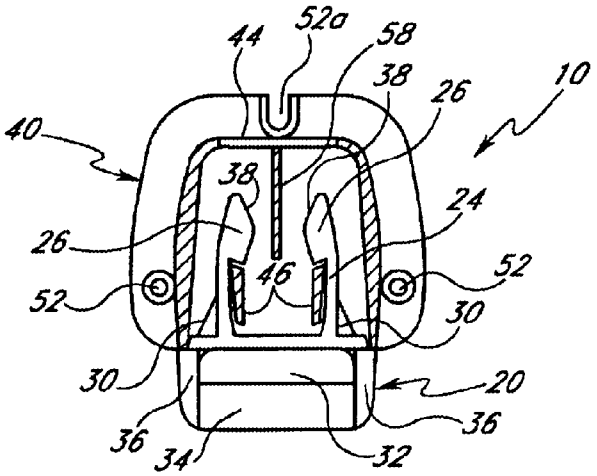
FIG. 3 is a partial sectional view of the clip and lock portions of FIG. 1 assembled.
Figure 4:
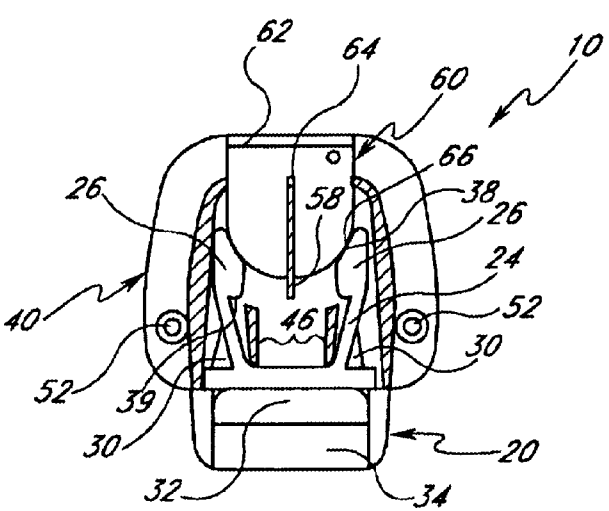
FIG. 4 is a partial sectional view illustrating the disengagement of the clip portion from the lock portion of the assembly of FIG. 1 by inserting the key portion.

With reference to FIGS. 1, 3 and 4, the legs 24 are preferably substantially resilient, thus allowing them to flex slightly as they engage the posts 46 within the female lock portion 40. Webs 30 may be provided on the sides of the legs 24 in order to provide additional strength and rigidity. In the embodiment shown, the legs 24 are biased toward one another in a substantially horizontal plane. Those skilled in the art will recognize, however, that a strap lock may be arranged such that the legs 24 are biased outwards. The barbed ends 26 of the legs 24 typically have angled leading surfaces 38 (FIG. 3) to allow the legs to be biased apart when the legs 24 engage the posts 46 as the portions are assembled.

Referring to FIG. 1, the second end 28 generally comprises a strap opening 32 formed by a bar 34 and a pair of sides 36. The bar 34 is shaped elliptically or rectangularly for receiving a strap. The bar 34 preferably has sufficient strength to support a strap attached thereto against the expected loading.

The female lock portion 40 generally comprises a flange or base 48 with the housing 50 extending upwards therefrom. In the application shown, the base 48 includes a plurality of holes 52 for attaching the female lock portion 40 to a surface (not shown). In one application, the female lock portion 40 is attached to an exterior side wall of a spa or Jacuzzi. Alternatively, the female lock portion 40 could be adapted to be mountable to portions of a backpack, an article of clothing, luggage, or any other article deemed appropriate by one of skill in the art. The holes 52 may be counter-bored as shown in order to prevent a head of a fastener (such as a bolt, screw, rivet, etc.) from extending substantially above the top surface of the base 48. In one embodiment a slotted hole 52*a* may be provided in the flange 48 near the keyhole 44. The slotted hole 52*a* also provides a vehicle to fasten the female lock portion 40 to a surface.

Figure 5:
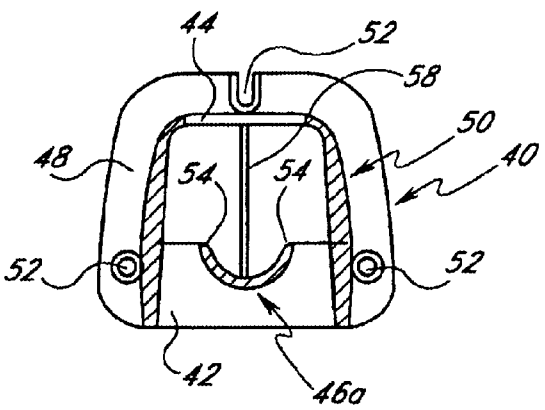
FIG. 5 is a partial section view of an alternative embodiment of a lock portion having desired features and advantages.

As mentioned above, the female lock portion 40 also preferably includes one or more posts 46 adapted to engage the barbed ends 26 of the male clip portion 20. The embodiment shown in FIGS. 3 and 4 includes a pair of posts 46 sized and positioned to engage the legs 26 of the male portion 20 to substantially securely couple the male clip portion 20 to the female lock portion 40. The posts 46 of FIGS. 3 and 4 are substantially linear, and extend between the top of base 48 and the interior top of housing 50. The posts are preferably formed such that they are substantially rigid. In an alternative embodiment, the posts 46 may be formed as a single piece 46*a*, as shown for example in FIG. 5. The post 46*a* of FIG. 5 comprises a semicircular arc, the end points 54 of which will engage the barbed ends 26 of a male clip portion 20. Those skilled in the art will recognize that the post(s) 46 may be provided in a variety of shapes in order to function as described herein.

Figure 6:
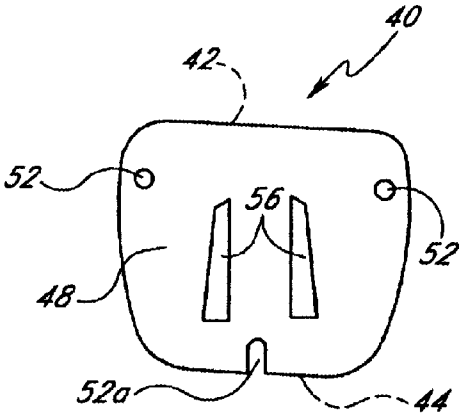
FIG. 6 is a bottom view of one embodiment of a lock portion having desired features and advantages.

As illustrated in FIG. 6, the underside of the base 48 of the female lock portion 40 may include longitudinal slots 56 extending between the first and second openings 42, 44. The slots 56 provide for reduced mass of the female lock portion 40 for reducing the cost of manufacture.

The female lock portion 40 also optionally includes a key-centering web 58 or other structure within the housing 50 adapted to maintain the key 60 in an operative position relative to the male clip and female lock portions 20, 40. Those skilled in the art will recognize that additional centering or strengthening webs beyond those shown and described herein may be desirable for further positioning or support of the various components described herein.

As shown in FIG. 3 and 4, the key portion 60 is generally adapted to release or disengage the barbed ends 26 of the legs 24 from the posts 46 upon insertion of the key portion 60 into the keyhole opening 44. The manner in which the key portion 60 disengages the male portion 20 from the female portion 40 will depend on the particular arrangement of those parts. For example, the key may be adapted to bias the legs towards one another, or to bias a leg upwards, downwards, or otherwise bias or displace a leg in order to disengage a barbed end from the female lock portion.

In the illustrated embodiment, the key portion 60 is adapted to bias the legs 24 slightly outwards apart from one another. As seen best in FIG. 1, one embodiment of a key portion 60 is a substantially elongated 'D'-shaped, flat, rigid piece with a lip 62 at one end. The lip 62 may be adapted for engagement by a user in order to remove the key portion 60 from the keyhole opening 44 of the female lock portion 40. A slot 64 may be provided as shown in order to allow the key portion 60 to engage the centering web 58 disposed within the housing 50 of the female lock portion 40 as described above. The curved cam surfaces 66 of the D-shaped key portion are preferably adapted to engage the inner surfaces 38 of the barbed ends 26 in order to disengage the male clip portion 20 from the female lock portion 40.

The various components of the strap lock assembly 10 described herein may be made from the same or different materials, and by any appropriate process known to those skilled in the art. For example, in one embodiment the strap lock components are injection molded from a suitable thermoplastic. Alternatively, the components may be compression molded from a suitable thermoset plastic, machined or cast from a suitable metal, or otherwise made from an appropriate material known to those skilled in the art.

The functioning of the strap lock assembly will now be described with reference to FIGS. 1–4. The lock assembly 10 is closed by inserting the male portion 20 into the first opening 42 of the female lock portion 40. As the male clip portion 20 is advanced, the sloped surfaces 38 of the barbed ends 26 cause the legs 24 to be bent apart, allowing the continued advancement of the male clip portion 20. Once the male clip portion 20 has been fully advanced, the bias of the legs 24 will preferably cause the barbed portions 26 to 'click' into a position in which they engage the posts 46. In this final position (shown in FIG. 3), the male clip portion is preferably held substantially rigidly relative to the female portion 40 such that motion between the male and female portions is substantially limited. When it is desirable to release the lock assembly, the key portion is inserted into the keyhole opening 44 until the cam surfaces 66 of the key portion 60 engage the angled surfaces 38 of the barbed ends 26. The key portion 60 is then pressed into the keyhole opening 44 with sufficient force to separate the legs 24 of the male portion 20 as seen in FIG. 4. The bias of the legs 24 will cause the barbed ends 26 of the male portion 20 to move toward the first opening 42 of the female lock portion 40. The male clip portion 20 may then be pulled outwardly in order to completely remove the male clip portion 20 from the female lock portion 40.

Figure 7:
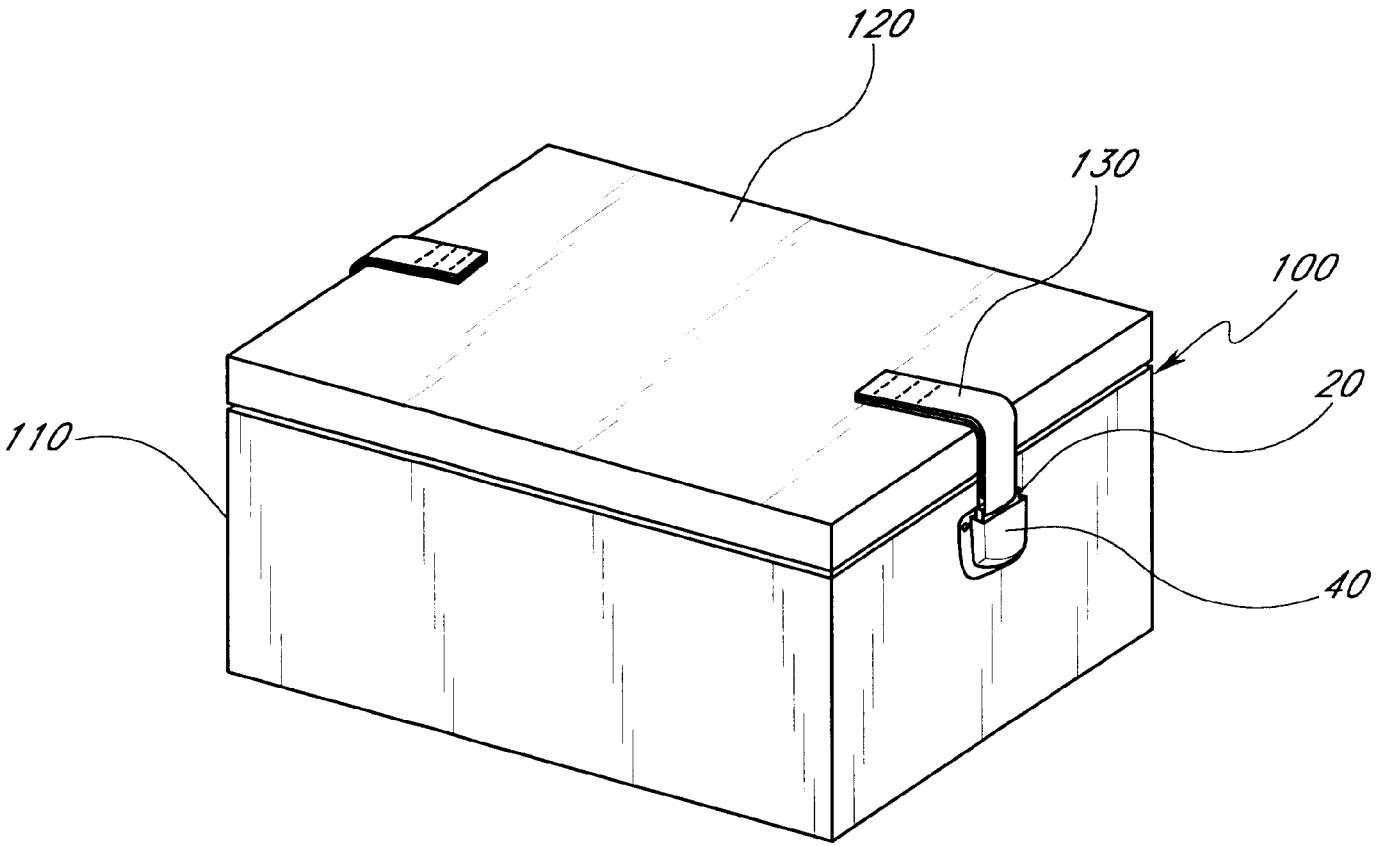
FIG. 7 is a perspective schematic view of one application of the present invention in which the strap lock assembly is employed to permit connection of a spa cover to a spa.

Referring to FIG. 7, one application of the present invention is shown. There a spa 100 is shown comprising a spa base 110 with a spa cover 120 placed on top of the spa base 110. Secured to the spa cover 120 is at least one strap 130 that, for example, is secured at the top and drapes over the side to engage a side wall of the spa base. Secured at one end of the at least one strap 130 is one embodiment of male portion 20, shown engaged with the female portion 40. The female portion is secured to, for example, the side wall of the spa base 110. By using the invention described herein, removal of the spa cover 120 can only occur (in a non-destructive manner) by using a key portion 60 to disengage the male portion 20 from the female portion 40, thereby permitting release of the strap 130 and, thus, removal of the spa cover 120.

Those skilled in the art will understand how to configure the relative sizes of the legs, barbs, posts, housing, and key for a particular application of the strap lock assembly. A strap lock having presently desirable features and advantages will preferably provide a sufficient locking force that the lock will remain closed under the expected loads. The skilled artisan will recognize that the particular magnitude and direction of the expected load will vary depending on the intended use of the lock, and will be able to build the lock appropriately.

Thus a strap lock assembly having presently preferred features will advantageously allow easy attachment of a flexible strap to a solid surface, with the additional advantage that the lock requires the use of a key to release the strap. This provides a secure connection against accidental or undesirable release of the strap. A strap lock as described above has applications for example as a child-proof spa cover lock, a somewhat tamper proof luggage or backpack lock, and many other uses.

Although certain preferred embodiments and examples have been described herein, it will be understood by those skilled in the art that the present inventive subject matter extends beyond the specifically disclosed embodiments to other alternative embodiments and/or uses of the invention and obvious modifications and equivalents thereof. Thus, it is intended that the scope of the present inventive subject matter herein disclosed should not be limited by the particular disclosed embodiments described above, but should be determined only by a fair reading of the claims that follow.

What is claimed is:

1. A strap lock assembly comprising a housing comprising a first opening adapted to receive a clip portion having first and second barbed legs configured to be biased towards one another, said housing also comprising a second opening adapted to receive a key portion, said housing including a post located between the first and second openings within an interior of said housing, and said barbed legs of said clip portion being adapted to flank and engage said post, wherein the key is configured so that insertion of said key portion into the second opening of the housing disengages said barbed legs from said post, thereby allowing the clip portion to be removed from the housing.

2. The strap lock assembly of claim 1, wherein the housing is mountable to a substantially rigid object having, in part, a flat surface to which the housing may be mounted.

3. The strap lock assembly of claim 2, wherein the solid object is a portion of a spa.

4. The strap lock assembly of claim 1, wherein the clip portion further comprises a strap-attachment portion.

5. The strap lock assembly of claim 1, wherein the post has a generally arcuate shape to permit engagement by at least one of the barbed legs of the clip portion.

6. The strap lock assembly of claim 1, said housing further comprising first and second posts, wherein each of the barbed legs of the clip portion is adapted to engage one of the first and second posts.

7. A quick-disconnect strap lock assembly comprising:

a female portion having a main opening, a key slot, and a post located between the key slot and the main opening;

a male portion having a first end insertable into said female portion, said first end comprising a pair of barbed legs biased in a plane which passes through the barbed legs, at least one of which is adapted to engage the post to securely connect the male portion to the female portion, said male portion also comprising a second end;

wherein insertion of a key into said key slot allows the male portion to be released from the female portion.

8. The quick-connect strap lock assembly of claim 4, wherein the second end of said male portion is adapted to have a strap securable thereto.

9. The quick-connect strap lock assembly of claim 8, wherein the female portion is mountable to a substantially rigid object.

10. The quick-connect strap lock assembly of claim 7, wherein the male and female portions are made by injection molding.

11. The quick-connect strap lock assembly of claim 7, wherein the barbed legs are configured to be biased away from one another to release at least one barbed leg from the post.

12. The quick-connect strap lock assembly of claim 7, wherein the post of the female portion is arcuate shaped.

13. The quick-connect strap lock assembly of claim 7, wherein the key comprises a pair of cam surfaces adapted to engage portions of said first and second barbed legs to disengage said barbed legs from said at least one post, and wherein the barbed legs and cam surfaces are configured such that the barbed legs are moved toward the main opening when the key is pressed into the key slot.

14. The quick-connect strap lock assembly of claim 7, wherein the at least one post is located between the barbed legs.

15. A system for removably locking a flexible strap to an object comprising:

a first portion having first and second ends, said first end having a pair of legs;

a key;

a second portion having a first opening sized to receive the legs of the first portion, and a second opening sized to receive the key;

wherein the first portion is configured to engage the second portion such that the first and second portions are held substantially securely relative to one another and wherein the key is configured to displace the legs in a plane parallel to a bottom surface of the second portion disengage the first portion from the second portion upon insertion of the key into the second opening.

16. The system of claim 15, wherein the second portion is mountable to an object and the second end of the first portion has a loop adapted to receive a flexible strap.

17. The system of claim 15, wherein the key is configured to displace the first and second legs away from one another along a line between the first and second legs.

* * * * *